US007851749B2

(12) United States Patent
Komatsu et al.

(10) Patent No.: US 7,851,749 B2
(45) Date of Patent: Dec. 14, 2010

(54) METHOD FOR OBTAINING INFORMATION AND DEVICE THEREFOR

(75) Inventors: Manabu Komatsu, Kawasaki (JP); Hiroyuki Hashimoto, Yokohama (JP); Yohei Murayama, Tokyo (JP); Kazuhiro Ban, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 12/017,584

(22) Filed: Jan. 22, 2008

(65) Prior Publication Data

US 2008/0179512 A1 Jul. 31, 2008

(30) Foreign Application Priority Data

Jan. 31, 2007 (JP) ..... 2007-021437

(51) Int. Cl.
*H01J 49/00* (2006.01)

(52) U.S. Cl. ..... 250/288; 250/287

(58) Field of Classification Search ..... 250/281–290, 250/423 R, 424, 427; 347/1, 2, 20, 6, 9
See application file for complete search history.

(56) References Cited

U.S. PATENT DOCUMENTS

| | | | | |
|---|---|---|---|---|
| 4,920,264 | A * | 4/1990 | Becker | 250/282 |
| 6,110,343 | A * | 8/2000 | Ramsey et al. | 250/288 |
| 6,707,038 | B2 * | 3/2004 | Ellson et al. | 250/288 |
| 7,701,138 | B2 * | 4/2010 | Hashimoto et al. | 313/564 |
| 2005/0035284 | A1 * | 2/2005 | Schultz et al. | 250/287 |
| 2005/0230615 | A1 * | 10/2005 | Furutani et al. | 250/287 |
| 2006/0118711 | A1 | 6/2006 | Murayama et al. | |
| 2006/0183235 | A1 | 8/2006 | Hashimoto et al. | |
| 2006/0202130 | A1 * | 9/2006 | Kollmer et al. | 250/281 |

(Continued)

FOREIGN PATENT DOCUMENTS

JP 2006-10658 A 1/2006

(Continued)

OTHER PUBLICATIONS

DiCola et al. "Persistence Length of Titin from Rabbit Skeletal Muscles measured with Scattering and Microrheology Techniques," BioPhysical Journal, vol. 88, Jun. 2005, 4095-4106.*

(Continued)

*Primary Examiner*—Jack I Berman
*Assistant Examiner*—Brooke Purinton
(74) *Attorney, Agent, or Firm*—Fitzpatrick, Cella, Harper & Scinto

(57) ABSTRACT

A method for obtaining information on a mass of an object by time-of-flight mass spectrometry. This method includes placing colloidal metal particles for promoting ionization of the object inside the object at a depth ranging from 0.1 nm to 100 nm in opposition to a primary beam for the ionization; irradiating the object with the primary beam selected from the group of ions, neutral particles, and electrons, which can be focused, pulsed, and are capable of scanning, and laser beams, which can be focused, pulsed, and are capable of scanning to ionize a constituent of the object and to allow the ionized constituent to fly out of the object; and obtaining information on the mass of the flying constituent of the object by time-of-flight mass spectrometry.

7 Claims, 6 Drawing Sheets

U.S. PATENT DOCUMENTS

2006/0211106 A1 9/2006 Komatsu et al.
2007/0158549 A1* 7/2007 Naya et al. ..... 250/288

FOREIGN PATENT DOCUMENTS

WO 2005/003715 A2 1/2005

OTHER PUBLICATIONS

Kuang Jen Wu et al., "Matrix-Enhanced Secondary Ion Mass Spectrometry: A Method for Molecular Analysis of Solid Surfaces," 68(5) Anal. Chem. 873-82 (Mar. 1996).

Anna M. Belu et al., "Enhanced TOF-SIMS Imaging of a Micropatterned Protein by Stable Isotope Protein Labeling," 73(2) Anal. Chem. 143-50 (with supporting information, pp. 1-4) (Jan. 2001).

David S. Mantus et al., "Static Secondary Ion Mass Spectrometry of Adsorbed Proteins," 65(10) Anal. Chem. 1431-38 (May 1993).

Matthew S. Wagner et al., "Limits of detection for time of flight secondary ion mass spectrometry (ToF-SIMS) and X-ray photoelectron spectroscopy (XPS): detection of low amounts of adsorbed protein," 13(4) J. Biomater. Sci. Polymer Edn 407-28 (2002).

Young-Pil Kim et al., "Gold Nanoparticle-Enhanced Secondary Ion Mass Spectrometry Imaging of Peptides on Self-Assembled Monolayers," 78(6) Anal. Chem. 1913-20 (2006).

Isobe Toshiaki et al., Eds., Experimental Medical Science, Additional Volume, Proteome Analysis, 2000, Yodosha Co., pp. 22-24 & 129-136.

* cited by examiner

[ANGIOTENSIN+H]$^+$

[NEUROTENSIN+H]$^+$

[ACTH+H]$^+$ $Au_3^+$

INTENSITY
x10³
1.5
1.0
0.5
1296 1298 1300 1302
MASS/u
[ANGIOTENSIN+H]⁺

INTENSITY
x10²
4.0
3.0
2.0
1.0
1672 1674 1676 1678
MASS/u
[NEUROTENSIN+H]⁺

INTENSITY
x10¹
2464 2467 2470
MASS/u
[ACTH+H]⁺

INTENSITY
x10⁴
5895 5905 5915
MASS/u
Au₃⁺

METHOD FOR OBTAINING INFORMATION AND DEVICE THEREFOR

BACKGROUND OF THE INVENTION

1. Field of the Invention

The present invention relates to a method for obtaining information and a device for obtaining information, particularly to a method for obtaining information relating to an object by time-of-flight mass spectrometry. The present invention relates also to a device for obtaining information according to the method.

2. Description of the Related Art

With progress in genome analysis in recent years, analysis of proteins, gene products in living bodies, has become increasingly important. Hitherto, the analysis of a protein formation mechanism and of protein function have been noted and are being developed. Most of the methods of analysis of proteins are based on a combination of the following techniques: (1) isolation and purification by two-dimensional electrophoresis or high-speed liquid chromatography (HPLC), and (2) detection by radiation analysis, optical analysis, mass analysis, or a like analysis method.

The basis of the protein analysis technique is proteome analysis. By this proteome analysis, proteins that are formed by genes and are actually working in a living body are analyzed to investigate functions of cells and causes of diseases. A typical analysis method comprises the following steps: (1) extraction of proteins from an objective biological tissue or cells, (2) isolation of the proteins by two-dimensional electrophoresis, (3) analysis of the proteins or fractions thereof by mass analysis, such as MALDI (matrix-assisted laser desorption)-time-of-flight mass spectrometry (MALDI-TOFMS), and (4) identification of the proteins by utilizing a database, such as a genome project.

Another analysis method comprises the following steps (ISOBE Toshiaki, TAKAHASHI Nobuhiro, Eds. "Experimental Medical Science, additional volume, Proteome Analysis" 2000, Yodosha Co.): (1) extraction of proteins from an objective biological tissue or cells, (2) digestion (or denaturation) of the extracted proteins, (3) analysis of the digested (or denatured) proteins by use of a system that combines liquid chromatography (LC) and ion-trap mass spectrometry (Ion-trap MS), and (4) construction of a database and identification of the proteins.

Such proteome analysis techniques are yielding successful results, for example, in the investigation of the role of a protein in recurrence or metastasis of cancer.

The inventors of the present invention disclosed a method and apparatus for obtaining information on two-dimensional distribution of proteins in a protein chip or a sliced living tissue by visualization using a TOF-SIMS system (time-of-flight secondary ion mass spectroscopy) (Japanese Patent Application Laid-Open No. 2006-10658). In this method, an ionization-promoting substance and/or a digestion enzyme is first applied onto the protein chip or the sliced living tissue by an ink-jet system, and then the information on the kind of protein (including information on the peptides formed by limited decomposition by the digestion enzyme) is visualized by a TOF-SIMS system with the positional information being retained.

Techniques mentioned below are known for analysis of a polypeptide by TOF-SIMS: detection of a polypeptide parent molecule having a large molecular weight by a pretreatment, such as MALDI of mixing a polypeptide and a matrix substance (K. J. Wu et al.: Anal. Chem. 1996, vol. 68, p. 873); detection by imaging a polypeptide by isotope-labeling of a part of a polypeptide with a secondary ion, such as $C^{15}N^{-}$ (A. M. Belu et al.: Anal. Chem. 2001, vol. 73, p. 143); estimation of the kind of a poly-peptide from the kinds of the fragment ions (secondary ions) of the amino acid residues and the relative intensity thereof (D. S. Mantus et al.: Anal. Chem., 1993, vol. 65, p. 1431); investigation of the detection limit of a polypeptide adsorbed on substrates by TOF-SIMS (M. S. Wagner et al.: J. Biomater. Sci. Polymer Edn., 2002, vol. 13, p. 407); and increase of detection sensitivity by chemically modifying a polypeptide with gold nano-particles (Y-P. Kim et al.: Anal. Chem., 2006, vol. 78, p. 1913).

The above-mentioned method for obtaining information disclosed by the inventors of the present invention (Japanese Patent Application Laid-Open No. 2006-10658) provides information on proteins in diseased tissue and normal tissue (including information on a limited decomposition of a peptide by a digestion enzyme). However, it is desirable to improve detection sensitivity in this method. The method disclosed in ISOBE Toshiaki, TAKAHASHI Nobuhiro, Eds. "Experimental Medical Science, additional volume, Proteome Analysis" 2000, Yodosha Co., detects the parent molecule, even a high-molecular polypeptide, with the molecular weight retained by inhibiting the decomposition caused by primary ion radiation. This method uses a mixture of the polypeptide and a matrix substance as the measurement specimen. Therefore, this method cannot provide information on the original two-dimensional distribution in the aforementioned protein chip. The method disclosed by A. M. Belu et al. (Anal. Chem. 2001, vol. 73, p. 143) labels a part of an objective polypeptide with an isotope and detects the polypeptide with a high spatial resolution of TOF-SIMS. However, the isotope-labeling of the objective polypeptide in every measurement is problematic. The method disclosed by D. S. Mantus et al. (Anal. Chem., 1993, vol. 65, p. 1431) estimates the kind of a polypeptide based on the fragment ions (secondary ions) of the amino acid residues and relative intensities thereof. This method cannot discriminate the polypeptides of analogous amino acid constituents in a mixture.

In another method, the sensitivity in parent molecule detection is improved by retarding formation of fragment ions of a polypeptide by use of a metal substrate or metal fine particles. In the method disclosed by M. S. Wagner et al. (J. Biomater. Sci. Polymer Edn., 2002, vol. 13, p. 407), the sensitivity is improved by promoting ionization of a parent polypeptide molecule. Specifically, in this method, a polypeptide is initially placed in a layer that is only several molecules thick in a thin film state on a metal substrate; a primary ion beam is projected through the polypeptide film to impact the substrate; the recoil energy from the substrate dissociates effectively the molecules on the substrate; and the dissociated molecules are allowed to fly upward freely out of the thin film. Thereby, the ionization of the polypeptide parent molecules is promoted by retarding the fragment-ionization of the polypeptide to improve the detection sensitivity. In the method disclosed by Y-P. Kim et al. (Anal. Chem., 2006, vol. 78, p. 1913), the polypeptide molecules are modified respectively at the one end by a gold fine particle and are allowed to orient on a substrate, and a primary ion beam is projected to impact against the gold fine particles in a manner similar to the above-mentioned method of M. S. Wagner et al. (J. Biomater. Sci. Polymer Edn., 2002, vol. 13, p. 407). Thereby, in this method, the molecules on the fine particles are dissociated and allowed to fly out by the recoil energy from the gold atoms to promote ionization of the polypeptide parent molecules and to improve the detection sensitivity. However, these two methods require the step of forming a several-molecule thin polypeptide film or the step of modifying the polypeptide with gold fine particles. Therefore, these two methods cannot provide information on the two-dimensional distribution of the polypeptides in a protein chip or a biological specimen.

Accordingly, for analysis of a protein chip or a biological specimen by TOF-SIMS, improvement is desired for sensitivity in detection of polypeptide parent molecule ions without decomposition into fragments by secondary ions. The improvements disclosed so far are not satisfactory, as discussed above.

The present invention is made to solve the above-noted problems that exist in the prior art and is intended to provide a method for obtaining information for deriving a two-dimensional distribution image with high spatial resolution. Also, the present invention is intended to provide a device for practicing the method for obtaining the information.

SUMMARY OF THE INVENTION

The present invention is directed to a method for obtaining information on a mass of an object by time-of-flight mass spectrometry comprising: placing colloidal metal particles for promoting ionization of the object inside the object at a depth ranging from 0.1 nm to 100 nm in opposition to a primary beam for the ionization; irradiating the object with the primary beam selected from the group of ions, neutral particles, and electrons, which can be focused, pulsed, and are capable of scanning, and laser beams, which can be focused, pulsed, and are capable of scanning to ionize a constituent of the object and to allow the ionized constituent to fly out of the object; and obtaining information on the mass of the flying constituent of the object by time-of-flight mass spectrometry.

The colloidal metal particles can be placed inside the object by at least one method selected from the group of micro-injection methods, PEG methods, laser methods, particle gun methods, and ink-jet methods.

The method further can comprise a step of obtaining information on a distribution state of the constituent in the object.

The information on the distribution state of the constituent in the object can be obtained from two-dimensional distribution of the constituent in the object.

The diameters of the colloidal metal particles can range from 1 nm to 100 nm.

The colloidal metal particles can contain at least one metal selected from the group consisting of gold, silver, copper, platinum, palladium, rhodium osmium, ruthenium, iridium, iron, tin, zinc, cobalt, nickel, chromium, titanium, tantalum, tungsten, indium, and silicon, or an alloy thereof.

The primary beam can be an ion beam.

The object can be derived from biological bodies including cells and tissues.

The present invention is also directed to a device for obtaining information on a mass of an object by means of time-of-flight mass spectrometry comprising: a first means for placing colloidal metal particles for promoting ionization of the object inside the object at a depth ranging from 0.1 nm to 100 nm in opposition to a primary beam for the ionization; a second means for irradiating the object with the primary beam selected from the group of ions, neutral particles, and electrons, which can be focused, pulsed, and are capable of scanning, and laser beams, which can be focused, pulsed, and are capable of scanning, to ionize a constituent of the object and to allow the ionized constituent to fly out of the object; and a third means for obtaining information on the mass of the flying constituent of the object by time-of-flight mass spectrometry.

The present invention enables formation of parent molecule ions of a constituent of an object at a high efficiency and enables detection by imaging with retention of the two-dimensional distribution state of the constituent. The present invention also enables observation of the distribution of the constituent in a fine region on the surface of an object.

Further features of the present invention will become apparent from the following description of exemplary embodiments with reference to the attached drawings.

DESCRIPTION OF THE EMBODIMENTS

The present invention is described below in more detail with reference to the drawings.

Method of the Present Invention for Obtaining Information

Figure 1:
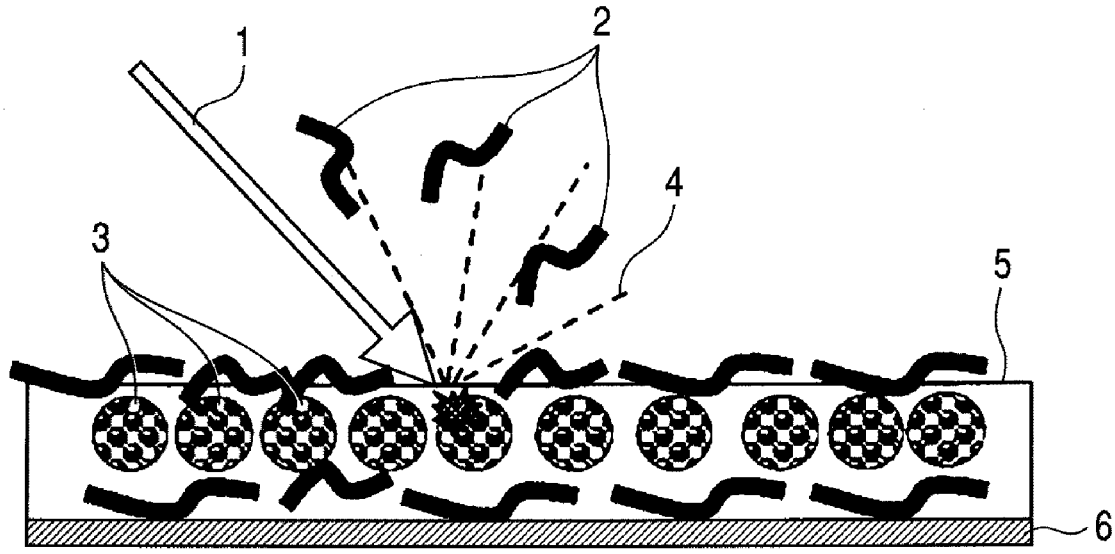
FIG. 1 illustrates schematically the principle of the method for obtaining information of the present invention.

FIG. 1 illustrates schematically the principle of the method of the present invention for obtaining information. In the method of the present invention for obtaining information, firstly, colloidal metal particles 3 are placed in the interior of object 5 of information to promote ionization of object 5 in opposition to primary beam 1. Primary beam 1 is projected to target position 4 of object 5 to ionize constituent 2 of object 5 and to allow the ionized material to fly outside. Then, information on the mass of the respective flying ions of constituent 2 is obtained by time-of-flight mass spectrometry. Thereafter, from the information on the measured masses, the distribution state of the constituent in the information object is derived.

The method of placing the colloidal metal particles inside the object is not limited, provided that the colloidal metal particles can be placed at a certain depth below the surface of the object in opposition to the projected primary beam. For example, when the information object is a solution of a mixture, a layer of colloidal metal particles is formed preliminarily on a substrate, and the solution of the object is applied in a layer on the colloidal metal particle layer. Otherwise, the colloidal metal particles may be placed inside the information object by micro-injection by a capillary or a catheter, a PEG method, a laser method, a particle gun method, or an ink-jet method. These methods are useful particularly for the information object derived from a biological material, such as cells and tissues.

In the case where the primary beam is used for placing the colloidal metal particles inside the object, the projection energy of the primary beam may be in the range from 15 keV to 25 keV. Thereby, the beam penetrates into the organic film to a depth ranging from 20 nm to 40 nm. With the colloidal metal particles placed between the surface and the object, the aforementioned various information can be obtained at the various depths.

In the case where a micro-injection method is employed for placing the colloidal metal particles inside the object, the particles may be injected obliquely downward into the object to place the particles at a certain depth inside the object.

Thereby, the distribution of the constituent can be detected (imaged) at a spatial resolution as fine as sub-microns without destroying the distribution of the constituent in the detection region.

A particle gun method is also preferred, in which the depth of the particles can be adjusted by controlling the gas pressure, and many particles can be injected relatively easily into an intended region.

The ink-jet method employing a solution containing colloidal metal particles is also preferred for placing the colloidal metal particles inside the object, since this method enables uniform arrangement of many colloidal metal particles.

The methods of placing the colloidal metal particles inside the object by a high pressure, such as the micro-injection method and the particle gun method, are somewhat disadvantageous in that precise adjustment of the high energy of the colloidal metal particles for the placement is necessary, although the placement can be conducted with high precision. Further, in the particle placement, the dispersion of the energy applied to the colloidal metal particles and the direction of the arrangement should be precisely controlled. In particular, for obtaining information from a sliced tissue or a like tissue-derived object by the method of the present invention, fine dispersion of a sub-micron order required for the analysis of such an object cannot be readily achieved. For placing the particles more readily and in a greater number on a sub-micron level uniformly inside the object, an ink-jet system is preferred, which ejects a solution of the colloidal metal particles in water or a suitable solvent. In this ink-jet method, the composition and amount of the solvent for the colloidal metal solution and the ejection angle and ejection distance of the solution are preferably adjusted to evaporate the solvent and to allow only the colloidal metal particles to reach the object. The ink-jet apparatus employed in typical ink-jet printing ejects the ink at an ejection velocity of tens of meters per second. This ejection velocity corresponds to several kgf/cm$^2$ in terms of the energy in the particle gun method. This energy can be sufficient for placing the colloidal metal particles inside the object. However, in the ink-jet method, when the ejected solution in a droplet state collides with the surface of the object, the solvent of the colloidal metal solution can serve as a physical cushion to dissipate the energy to decrease considerably the energy of the ejection of the colloidal metal solution on collision and to retard the penetration of the particle into the object. Therefore, in placing the colloidal metal particles inside the object by ejecting a colloidal metal solution by an ink-jet method, only the colloidal metal particles are preferably allowed to reach the object after the solvent evaporates from the solution.

In placing the colloidal metal particles inside the object, the colloidal metal particles may be in a solid or liquid state. The colloidal metal particles may be dispersed in a solvent, such as water.

In placing the colloidal metal particles inside the object, the direction of placing the colloidal metal particles into the object is not limited, insofar as the above requirements are satisfied. For example, the particles may be placed from above the object relative to the substrate for supporting the object. The particles may be placed at an angle of less than 90° to the object surface. Otherwise, without employing a substrate plate, nozzles of a multi-nozzle micro-injection device are inserted from the back face into the object and many particles are placed effectively at one time in the intended positions inside the object.

In placing the colloidal metal particles inside the object, to prevent the breakdown of object 5 at position 4 of the projection of primary beam 1, a material for cushioning the impact of the primary beam 1 may be placed on or above the projection position 4. The cushioning material includes solids and liquids, such as paper and gel solutions.

In the information-obtaining method of the present invention, the colloidal metal particles are placed preferably at a depth ranging from 0.1 nm to 100 nm below the surface of the object in opposition to the primary beam. At the depth of more than 100 nm, the necessary energy cannot be provided to the colloidal metal particles by the primary beam, since the primary beam penetrates the object, such as a cell membrane constituted of organic matter, before the impact against the colloidal metal particles. On the other hand, at the depth of less than 0.1 nm, the amount of the object material is not sufficient for generating the necessary ion signals for detection.

The placement depth (or arrangement positions) of the colloidal metal particles in the object relative to the primary beam can be measured by polarization analysis, such as ellipsometry. The placement depth can also be determined by means of time-of-flight mass spectrometry by utilizing the intensity of the metal ion species constituting the colloidal metal particle inversely proportional to the arrangement depth and extrapolation thereof, as mentioned below, although this method does not provide the absolute depth of the arrangement. In particular, in the case where Au (gold) is used as the metal of the colloidal metal particles, the arrangement depth can be estimated by measuring $Au_3^+$ generated by projection of the primary beam, as mentioned below, as an index.

In the information-obtaining method of the present invention, the step of ionizing the constituent of the object to allow the ions to fly outward is not limited, insofar as the constituent is ionized by the primary beam of an ion-mass spectrometer and the ions are allowed to fly outward.

In the information-obtaining method of the present invention, the primary beam for ionizing the constituent of the object includes beams of ions, neutral particles, and electrons, which can be focused, and pulsed, and is capable of scanning. A laser beam, which can be focused, and pulsed, and is capable of scanning, may also be employed as the primary beam. Among them, the primary beam is preferably an ion beam.

The primary ion species of the primary beam include gallium ions, cesium ions, gold (Au) ions, bismuth (Bi) ions, and carbon fullerene ($C_{60}$) in consideration of the ionization efficiency, mass resolution, and other factors. Of these, the use of any of Au ions, Bi ions, and $C_{60}$ ions is preferred for higher sensitivity of the analysis. The polyatomic ions of Au and Bi, $Au_2$ ions, $Au_3$ ions, $Bi_2$ ions, and $Bi_3$ ions are also useful, and the sensitivity can increase in the named order. In particular, polyatomic ions of gold and bismuth are suitable.

The primary ion beam is pulsed preferably at a pulse frequency ranging from 1 kHz to 50 kHz with the pulse width ranging from 0.5 ns to 10 ns, and has a beam energy ranging preferably from 12 keV to 25 keV.

In the measurement in the present invention, the primary ion beam is preferably less focused for higher mass resolution and shorter measurement time (tens of seconds to tens of minutes for one measurement) for higher quantitative determination precision. Specifically, the diameter of the primary ion beam is preferably in the range from 1 μm to 10 μm, not focusing to a sub-micron order.

Thus, the object constituent on the primary beam irradiation side on the colloidal metal particles is ionized by projection of the primary beam onto the object, and the formed constituent ions are allowed to fly upward by the recoil energy given by the primary beam without hindrance.

In the information-obtaining method of the present invention, the information on the mass of the constituent is obtained from the information on the mass of the secondary ion of the constituent obtained in the step of ionization of the object constituent and emission of the ionized constituent of the object by means of a time-of-flight mass spectrometer. This information-obtaining step may be conducted by a normal TOF-SIMS method.

In the information-obtaining method of the present invention, the mass of the constituent of the object includes the mass numbers of the ions mentioned in the items (1) to (3) below obtained by primary beam irradiation in the presence of colloidal metal particles placed inside the object: (1) the mass number of the adduct of the object with the metal of the colloidal metal particles, (2) the mass number of the adduct of the object with the metal of the colloidal metal particles and additionally 1 to 10 atoms selected from the group of the atoms of hydrogen, carbon, nitrogen, and oxygen, and (3) the mass number of the elimination product formed from the adduct defined in the above items (1) and (2) by elimination of 1 to 10 atoms selected from the group of hydrogen, carbon, nitrogen, and oxygen.

In the information-obtaining method of the present invention, the information on the state of distribution of the constituent in the object can be obtained by an imaging treatment using information on the position of the constituent on the substrate and the information on the mass of the flying constituent. Alternatively, the information on the state of distribution of the constituent in the object may be two-dimensional distribution of the constituent in the object.

In particular, in this imaging treatment, the image of the peak (intensity) in the mass spectrum corresponding to the constituent on the XY plane may be displayed as a two-dimensional distribution image of the above-mentioned protein on the three-dimensional data of the object derived by the TOF-SIMS measurement. When information on two or more constituents is obtained, the above treatment is repeated. By such treatment, the distribution of the quantity of every intended constituent of the object on the substrate can be estimated. Further, by correlation of the two-dimensional image display of the intensity of the secondary ion species with the image of the surface of the object measured separately by microscopic observation, the local site of the constituent in the object can be identified.

In the information-obtaining method of the present invention, characteristically, the two-dimensional distribution in the object is detected (imaged) by use of a secondary ion capable of identifying the object. This secondary ion has a mass/charge ratio of preferably not less than 500, more preferably not less than 1000.

Object

The information-obtaining method of the present invention can be applied to any organic matter, such as a protein and a peptide (hereinafter referred to as a "polypeptide"), without limitation. The object includes cells derived from an internal organ and sliced biological tissues of a biological body. The object is preferably in a solid state.

In the information-obtaining method of the present invention, the object is fixed on a substrate by any conventional method.

Substrate

In the information-obtaining method of the present invention, the substrate for supporting the object may be any solid matter, provide that the solid matter will not prevent the detection of information on the mass of the above constituent derived by irradiation of a primary beam onto the object. Specifically, the substrate includes an electroconductive material, such as silicon, and an insulating material, such as organic polymers and glass. The substrate need not necessarily be plate-shaped, but may be powdery, granular, or have any other shape.

Colloidal Metal Particles

In the information-obtaining method of the present invention, the material for constituting the colloidal metal particles includes the metals mentioned below or alloys containing at least one of the metals. Specifically, the metal includes gold, silver, copper, platinum, palladium, rhodium, osmium, ruthenium, iridium, iron, tin, zinc, cobalt, nickel, chromium titanium, tantalum, tungsten, indium, and silicon. Of these, gold, which is readily available and provides higher ion-detection sensitivity, is preferred. The particle size of the colloidal metal particles is not specifically limited and may be in the range from several nm to several hundred nm as commercial colloidal metal particles: preferably in the range from 1 nm to 100 nm. With the particles having a size outside the above range, the recoil energy will be excessively high, in consideration of the primary beam density of one beam/100 $nm^2$, under typical measurement conditions, and the recoil energy propagation region of about 100 $nm^2$. In particular, in consideration of a primary ion beam projection density in a typical measurement time, in TOF-SIMS analysis, minimizing the damage to the object caused by the particle projection, the colloidal metal particles has preferably a particle size ranging from 10 nm to 50 nm.

Information-Obtaining Device of the Present Invention

The information-obtaining device of the present invention obtains information on a mass of an object using a time-of-flight mass spectrometer. This information-obtaining device comprises a first means for placing colloidal metal particles for promoting ionization of the object inside the object in opposition to a primary beam for the ionization; a second means for irradiating the object with the primary beam selected from the group of ions, neutral particles, and electrons, which can be focused, pulsed, and are capable of scanning, and laser beams, which can be focused, pulsed, and are capable of scanning to ionize a constituent of the object and to allow the ionized constituent to fly out of the object; and a third means for obtaining information on the mass of the flying constituent by time-of-flight mass spectrometry. The information-obtaining device of the present invention may further comprise a means for obtaining information on distribution of the constituent in the object.

In the information-obtaining device of the present invention, the first means for placing the colloidal metal particles inside the object corresponds to a means for conducting the step of placing the colloidal metal particles inside the object in the information-obtaining method of the present invention. In the information-obtaining device of the present invention, the second means for irradiating the object to ionize the constituent of the object to allow the ionized constituent to fly out of the object corresponds to a means for conducting the step of ionizing the constituent of the object to emit the object in the aforementioned information-obtaining method of the present invention. In the information-obtaining device of the present invention, the third means for obtaining the information on the mass of the constituent corresponds to a means for conducting the step of obtaining the information on the mass of the constituent in the aforementioned information-obtaining method of the present invention. In the information-obtaining device of the present invention, the means for obtaining the distribution state of the constituent in the object corresponds to the means for conducting the step of obtaining the information on the distribution state of the constituent in the object in the aforementioned information-obtaining method of the present invention.

EXAMPLES

The present invention is described below more specifically with reference to examples.

In Example 1, the colloidal metal particles were simply dispersed in the object. In Example 2, the object was placed on the colloidal metal particles. In Example 3, the colloidal metal particles were placed inside the object. These Examples are mentioned for the purpose of describing best modes of the present invention without limiting the invention in any way.

Example 1

Analysis by TOF-SIMS of Polypeptide Film Containing Colloidal Gold Particles Mixed Therein In the present invention, the colloidal metal particles should be placed inside the object at a certain depth. Preliminarily, the effect of the present invention was confirmed with a polypeptide film as a sample in which colloidal gold particles were simply dispersed.

First, preparation of the sample is described. A pure silicon plate of 1×1 $cm^2$ as the substrate was washed successively with acetone and deionized water. The polypeptide sample was prepared as discussed below. The substances shown below were dissolved in portions of deionized water, respectively, at a concentration of 1 ng/μL, and 100 μL portions of the respective solutions were mixed together. Hereinafter, this mixture of the aqueous solutions is referred to as a mixed polypeptide solution.

Angiotensin I (SEQ ID NO:1, bovine-derived, average molecular weight: 1295.51, hereinafter referred to as angiotensin) (New England Biolabs Co.) Neurotensin (SEQ ID NO:2, bovine-derived, average molecular weight: 1672.96) (New England Biolabs Co.) ACTH (adrenocorticotropic hormone) (18-39) (SEQ ID NO:3, bovine-derived; average molecular weight, 2465.72; hereinafter referred to as "ACTH") (New England Biolabs Co.)

Next, 100 μL of a colloidal gold particle solution (particle size, 40 nm; dispersed at a concentration of 0.6 milli-mass % in an aqueous 1M citric acid solution) was mixed with the above-mentioned mixed polypeptide solution. The resulting mixture was stirred gently. A 20 μL portion of this mixture was dropped by a micro-pippeter on the silicon substrate and air-dried to form a several μm thick film having a diameter of about 2 mm.

Separately, another film was formed as a reference sample in a thickness of several μm without employing the colloidal gold particles in the same manner as above.

The measurement was conducted under the conditions shown below. The TOF-SIMS-5 (ION-TOF GmbH) apparatus was used in the TOF-SIMS analysis.

Primary ion: 25 kV $Bi^+$, 0.3 pA (pulse current), in a saw-tooth scanning mode; Pulse frequency of primary ion: 3.3 kHz (300 μsec/shot); Pulse width of primary ion: ca. 0.8 nsec; Diameter of primary ion beam: ca. 3 μm; Measurement region area: 300 μm×00 μm; Pixel number of secondary ion image: 128×128; Integration time: ca. 400 sec.

Figure 2A:
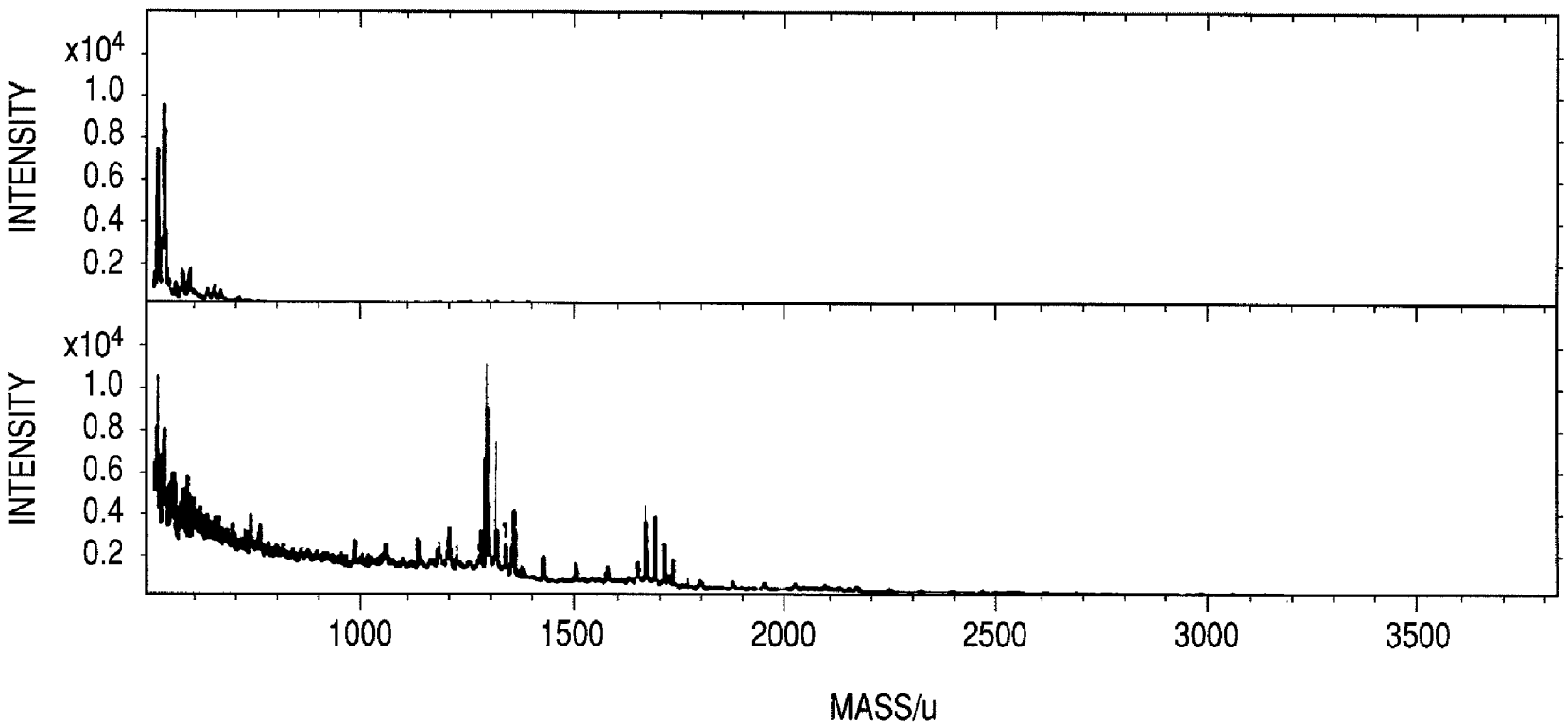
FIGS. 2A, 2B, 2C, 2D and 2E show the mass spectra of the positive secondary ions in Example 1.
Figure 2B:
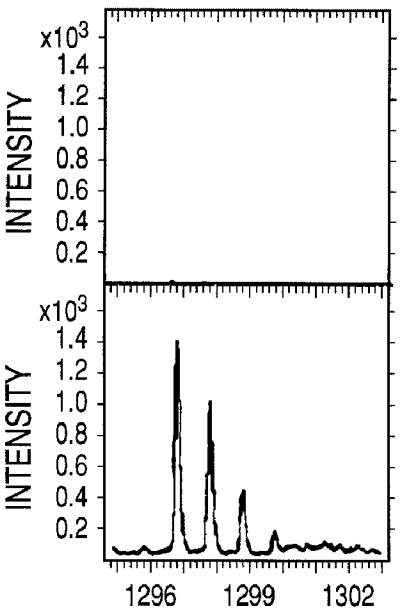
Figure 2C:
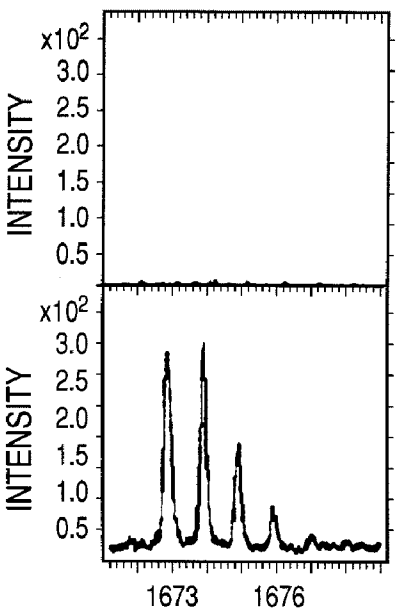
Figure 2D:
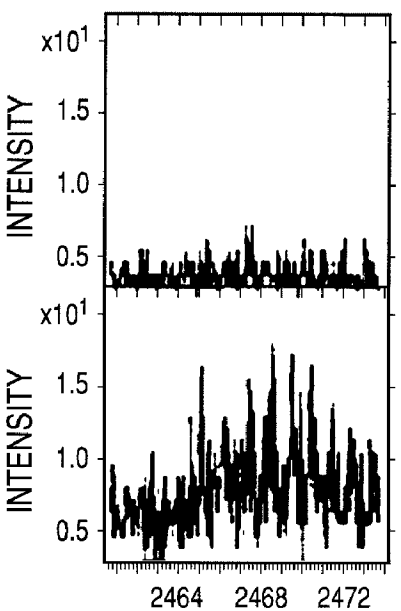
Figure 2E:
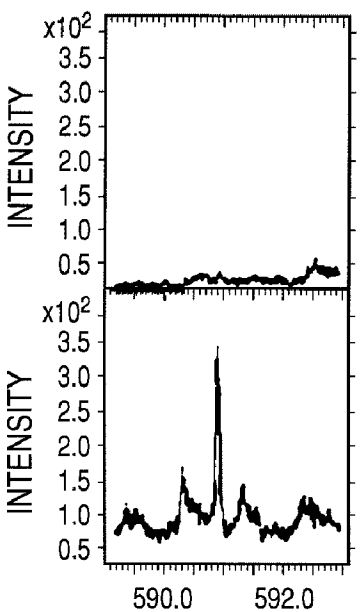

Under the conditions described above, the positive secondary ion mass spectra were measured. FIGS. 2A to 2E show the measured spectra. In FIGS. 2A to 2E, the upper charts are, respectively, the spectrum of the reference sample containing only the polypeptide solution without employing the colloidal gold particles, and the lower charts are, respectively, the spectrum of the sample containing the polypeptide solution and the colloidal gold particles. FIG. 2A shows the spectrum in the broad mass region. FIGS. 2B to 2E show partial enlargements of the spectrum of the broad mass region: FIG. 2B, [angiotensin+H]; FIG. 2C, [neurotensin+H]; FIG. 2D, [ACTH+H]; and FIG. 2E, $Au_3^+$.

Example 2

TOF-SIMS Analysis of Polypeptide Films of Various Thickness Formed on Gold Substrate For achieving the highest effect of the present invention, the colloidal gold particles are placed preferably at a certain depth at the intended position in the object. To find the optimum embedding depth of the colloidal gold particles in the film via a simulation, thin polypeptide films were formed in various thicknesses on the gold substrate by spin coating and the effect of the thickness was evaluated by a TOF-SIMS measurement.

The sample was prepared as follows. A pure silicon substrate of a size of 1×1 $cm^2$ was washed successively with acetone and deionized water, and gold was deposited thereon in a thickness of several hundred nm by vapor deposition for use as the gold-coated substrate. The aforementioned mixed polypeptide solution in Example 1 was used as the polypeptide in this Example. This polypeptide solution was spotted with a micro-pipetter in 10 μL portions on the gold-coated substrate, and the spots were formed into films by spin-coating at a rotation speed of 1500 rpm. The thickness of the mixed polypeptide film was changed by changing the spotting times from one to four. These spotted films were air-dried for TOF-SIMS analysis.

The relative thicknesses of the polypeptide films were determined from the signals of $Au_3^+$ on the gold surface produced on irradiation of the first beam.

Figures 3A, 3B, 3C, 3D:
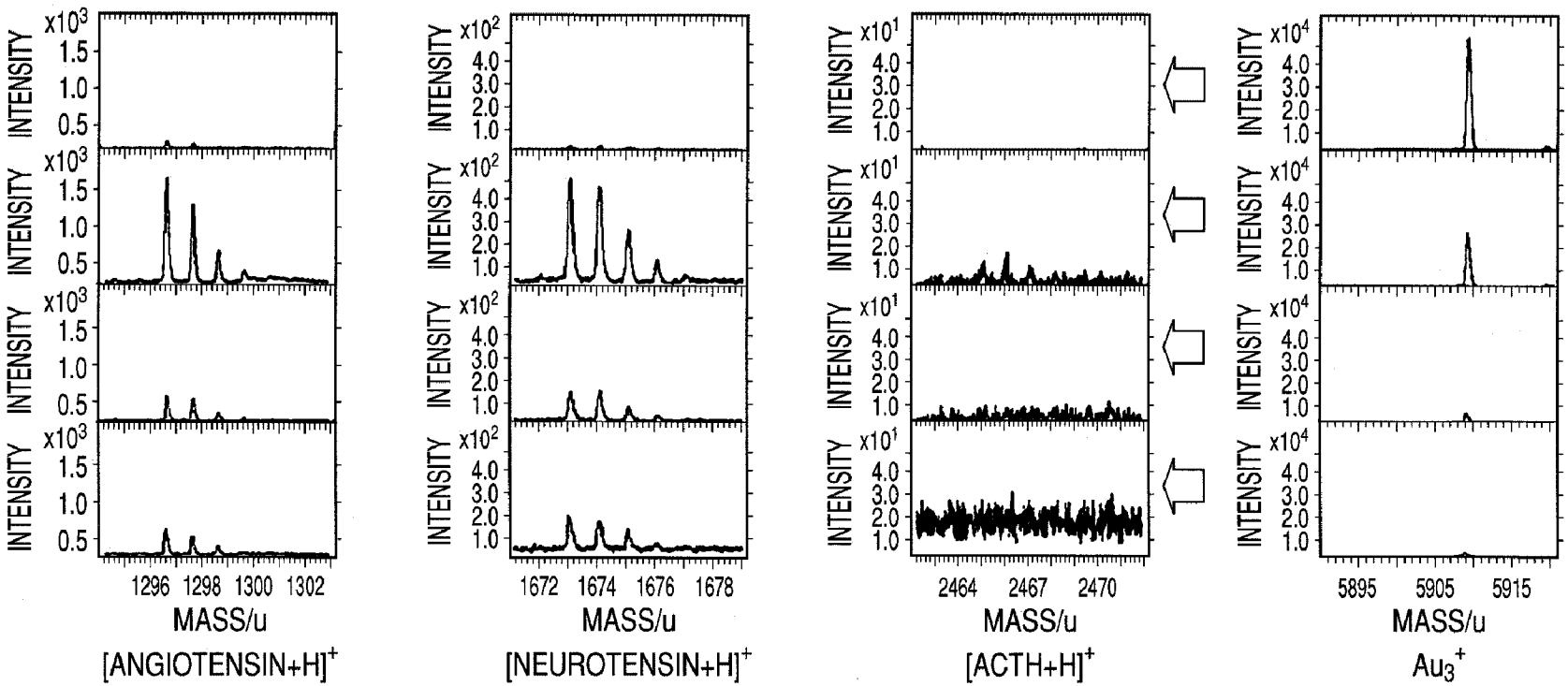
FIGS. 3A, 3B, 3C and 3D show the mass spectra of the positive secondary ions in Example 2.

The measurement was conducted under the same conditions as in Example 1. FIGS. 3A to 3D illustrate the measured spectra: FIG. 3A, [angiotensin+H]; FIG. 3B, [neurotensin+H]; FIG. 3C, [ACTH+H]; and FIG. 3D, $Au_3^+$. The signals of the parent molecule ions (with +H added) of the polypeptides were detected depending on the sample film thickness (inversely proportional to the $Au_3^+$ signal intensity). The signal intensities of the polypeptides were the highest at the film thicknesses giving the $Au_3^+$ signal intensity of $2.5\times10^4$ cnt/sec. This shows that the maximum effect of the present invention can be achieved at an optimum depth of the placement of the colloidal gold particles under the measurement position. It is expected that this maximum effect can be achieved by adjusting the depth to obtain the $Au_3^+$ signal intensity of about $2.5\times10^4$ cnt/sec as measured by TOF-SIMS under the aforementioned measurement conditions.

Example 3

Figure 4:
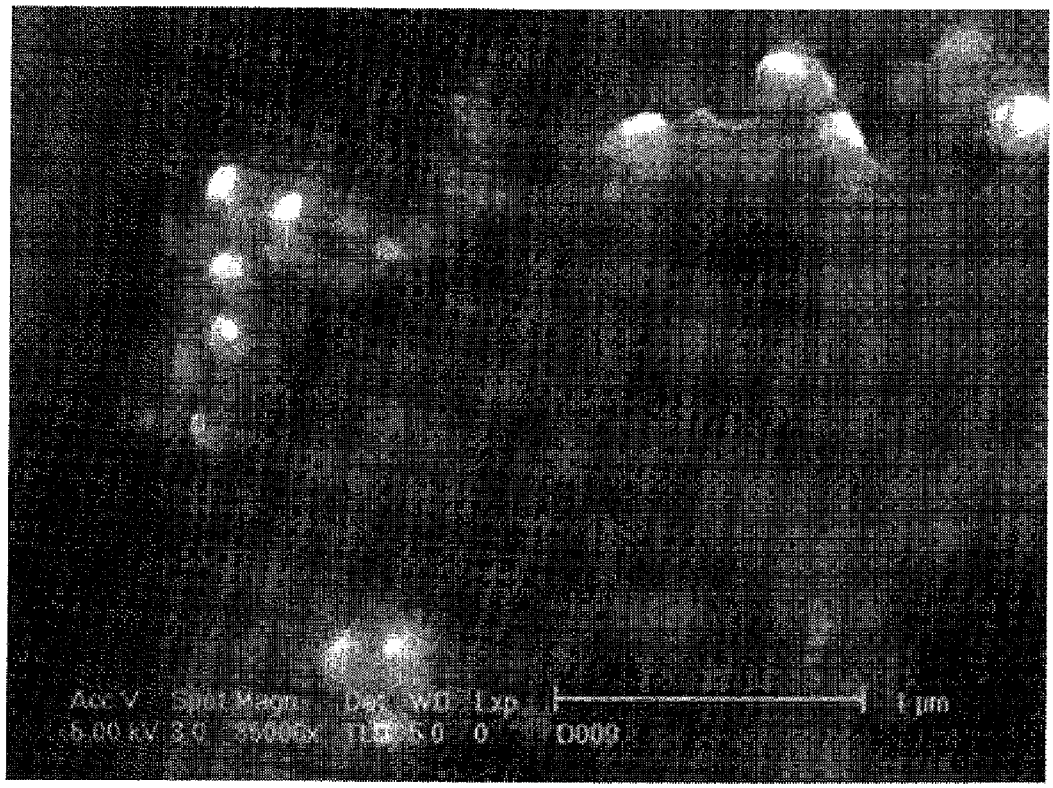
FIG. 4 is a scanning electromicrograph obtained in Example 3.
Figures 5A, 5B:
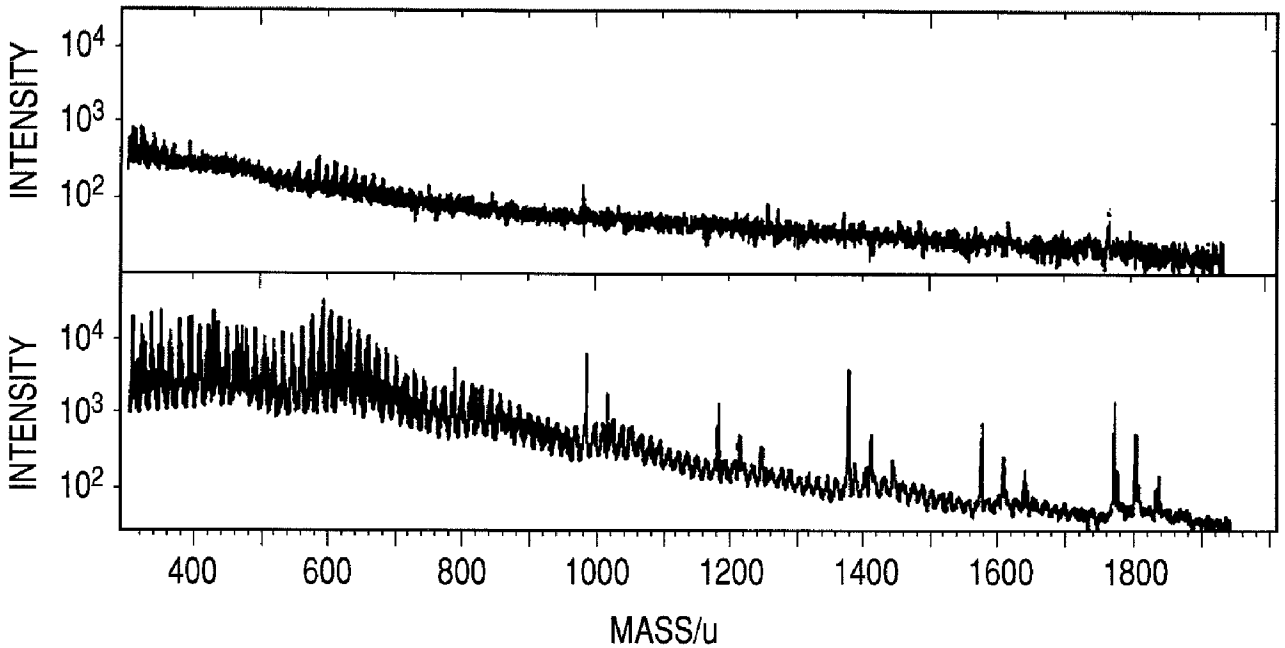
FIGS. 5A and 5B show the mass spectra of the positive secondary ions in Example 3.

Placement of Colloidal Gold Particles inside Biological Sample by Ink-Jet System For achieving the maximum effect of the present invention, a solution of the colloidal gold particles was injected into the lower part of the sample by an ink-jet system to place more colloidal gold particles uniformly inside the sample at a certain depth. The colloidal gold particle solution was the same as the one used in Example 1 (particle size, 40 nm; dispersed at a 0.6 m-mass % in aqueous 1M citric acid solution). The ink-jet system was of a thermal heating type (bubble jet®). As the printer, a commercial printer (Canon PIXUS990i: size of one droplet, 8 pL) was used, which had been modified to set the sample-supporting substrate of 1 cm square at the printing position at the droplet flight distance of 1 cm. The modification to change the liquid droplet flight distance enables evaporation of the solvent of the droplet during the flight and injection of the colloidal gold particles inside the sample. The biological sample used was a stomach wall tissue (isolated from a healthy person), which was sliced in a thickness of about 1 μm by a microtome. The sliced sample tissue was fixed with paraffin on an Si substrate, washed with ethanol, and air-dried sufficiently at room temperature at an atmospheric pressure. FIG. 4 is a scanning electromicrograph (SEM) of the surface of the sliced tissue into which the colloidal gold particles were actually injected. In FIG. 4, the round white portions indicate the colloidal gold particles of 40 nm in diameter. The highly bright portions indicate bared particles on the surface of the sample, and the less bright portions indicate the embedded colloidal gold particles. As shown in FIG. 4, the colloidal particles could be embedded inside the biological sample by the ink-jet system. This sample containing the colloidal gold particles injected by the ink-jet system was subjected to a measurement by TOF-SIMS in the same manner as in Example 1. FIGS. 5A and 5B show the results. FIG. 5A shows a TOF-SIMS spectrum of a sample on the surface of which the colloidal particle solution were ejected from a liquid droplet flight distance of 2 mm by means of an ordinary bubble jet printer. FIG. 5B shows a TOF-SIMS spectrum of the sample on the surface of which the colloidal particle solution was ejected in the same manner as mentioned above, except that the flight distance was changed to 1 cm. In the high mass region (400 amu or higher), with the sample shown in FIG. 5A, only peaks of the gold clusters were detected, whereas with the sample shown in FIG. 5B, many strong peaks were detected, which seems to be derived from fatty acids. This shows that the longer flight distance of the liquid droplet enables evaporation of the solvent component and injection of the colloidal metal deeper into the sample, whereby the secondary ion sensitivity is increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-021437, filed Jan. 31, 2007, which is hereby incorporated herein by reference in its entirety.

SEQUENCE LISTING

```
<160> NUMBER OF SEQ ID NOS: 3

<210> SEQ ID NO 1
<211> LENGTH: 10
<212> TYPE: PRT
<213> ORGANISM: Artificial
<220> FEATURE:
<223> OTHER INFORMATION: angiotensin I

<400> SEQUENCE: 1

Asp Arg Val Tyr Ile His Pro Phe His Leu
1               5                   10


<210> SEQ ID NO 2
<211> LENGTH: 13
<212> TYPE: PRT
<213> ORGANISM: Artificial
<220> FEATURE:
<223> OTHER INFORMATION: neurotensin

<400> SEQUENCE: 2

Gln Leu Tyr Glu Asn Lys Pro Arg Arg Pro Tyr Ile Leu
1               5                   10


<210> SEQ ID NO 3
<211> LENGTH: 22
<212> TYPE: PRT
<213> ORGANISM: Artificial
<220> FEATURE:
<223> OTHER INFORMATION: ACTH

<400> SEQUENCE: 3

Arg Pro Val Lys Val Tyr Pro Asn Gly Ala Glu Asp Glu Ser Ala Glu
1               5                   10                  15

Ala Phe Pro Leu Glu Phe
            20
```

What is claimed is:

1. A method for obtaining information on a mass of an object by a time-of-flight mass spectrometry, comprising:

placing colloidal metal particles for promoting ionization of the object inside the object at a depth ranging from 0.1 nm to 100 nm in opposition to a primary beam for the ionization;

irradiating the object with the primary beam selected from the group of ions, neutral particles, and electrons which can be focused, pulsed, and are capable of scanning, and laser beams which can be focused, pulsed, and are capable of scanning to ionize a constituent of the object and to allow the ionized constituent to fly out of the object; and obtaining information on the mass of the flying constituent of the object by time-of-flight mass spectrometry, wherein the colloidal metal particles are placed inside the object by an ink-jet method.

2. The method for obtaining information according to claim 1, further comprising a step of obtaining information on a distribution state of the constituent in the object.

3. The method for obtaining information according to claim 2, wherein the information on the distribution state of the constituent in the object is obtained from two-dimensional distribution of the constituent in the object.

4. The method for obtaining information according to claim 1, wherein diameters of the colloidal metal particles range from 1 nm to 100 nm.

5. The method for obtaining information according to claim 1, wherein the colloidal metal particles contain at least one metal selected from the group consisting of gold, silver, copper, platinum, palladium, rhodium, osmium, ruthenium, iridium, iron, tin, zinc, cobalt, nickel, chromium, titanium, tantalum, tungsten, indium, and silicon, or alloy thereof.

6. The method for obtaining information according to claim 1, wherein the primary beam is an ion beam.

7. The method for obtaining information according to claim 1, wherein the object is derived from a biological body including cells, and tissues.

* * * * *